US007814719B2

(12) United States Patent
Cretti

(10) Patent No.: US 7,814,719 B2
(45) Date of Patent: Oct. 19, 2010

(54) SELF-SUPPORTING CONSTRUCTION ELEMENT MADE OF EXPANDED PLASTIC MATERIAL, IN PARTICULAR FOR MANUFACTURING BUILDING FLOORS AND FLOOR STRUCTURE INCORPORATING SUCH ELEMENT

(75) Inventor: Piero Cretti, Morbio Superiore (CH)

(73) Assignee: Plastedil S.A., Chiasso (CH)

( * ) Notice: Subject to any disclaimer, the term of this patent is extended or adjusted under 35 U.S.C. 154(b) by 739 days.

(21) Appl. No.: 11/151,306

(22) Filed: Jun. 14, 2005

(65) Prior Publication Data

US 2006/0032187 A1 Feb. 16, 2006

(30) Foreign Application Priority Data

Jun. 14, 2004 (IT) ..... MI04A1189

(51) Int. Cl.
*E04B 1/16* (2006.01)

(52) U.S. Cl. ..... 52/340; 52/320; 52/319

(58) Field of Classification Search ..... 52/414, 52/340, 319–330
See application file for complete search history.

(56) References Cited

U.S. PATENT DOCUMENTS

| | | | | | |
|---|---|---|---|---|---|
| 1,602,985 | A * | 10/1926 | McWilliams | 52/577 |
| 1,661,009 | A * | 2/1928 | Payne | 138/115 |
| 3,178,856 | A * | 4/1965 | Grebner | 52/337 |
| 3,382,637 | A * | 5/1968 | Longinotti | 52/320 |
| 4,120,131 | A * | 10/1978 | Carroll | 52/310 |
| 4,133,155 | A * | 1/1979 | Oelrich | 52/372 |
| 4,157,460 | A | 6/1979 | Bottali et al. | |
| 4,157,640 | A | 6/1979 | Joannes | |
| 4,545,170 | A * | 10/1985 | Shirey | 52/670 |
| 4,599,840 | A * | 7/1986 | Ingvarsson et al. | 52/340 |
| 4,942,707 | A * | 7/1990 | Huettemann | 52/259 |
| 5,560,176 | A * | 10/1996 | Levo | 52/724.1 |
| 5,664,378 | A * | 9/1997 | Bettigole et al. | 52/414 |
| 5,797,230 | A * | 8/1998 | Lassen | 52/323 |
| 6,298,622 | B1 * | 10/2001 | Cretti | 52/309.7 |
| 6,484,464 | B1 * | 11/2002 | Ochoa | 52/414 |
| 6,568,139 | B2 * | 5/2003 | Bot | 52/250 |
| 6,955,014 | B2 * | 10/2005 | LeJeune et al. | 52/223.6 |
| 7,216,462 | B2 * | 5/2007 | LeJeune et al. | 52/223.6 |
| 2003/0014934 | A1 * | 1/2003 | Bodnar | 52/443 |

FOREIGN PATENT DOCUMENTS

CN 1425835 A 6/2003

(Continued)

*Primary Examiner*—David Dunn
*Assistant Examiner*—Daniel Kenny
(74) *Attorney, Agent, or Firm*—Sughrue Mion, PLLC

(57) ABSTRACT

A self-supporting construction element (1) is described, comprising:

a) an elongated body (2) made of expanded plastic material; substantially parallelepipedic and provided with respectively lower (8) and upper (9) opposite faces;

b) at least one reinforcing section bar (12, 13) transversely extending in the body (2) between the faces (8, 9);

wherein the elongated body (2) made of expanded plastic material is provided with at least one recess (14, 27) open at an upper side for housing a concrete casting (15) and wherein the reinforcing section bar (12, 13) extends at least in part in the aforementioned at least one recess (14, 27).

Advantageously, the construction element (1) exhibits both optimum self-supporting characteristics and a good fire resistance in case of fire.

25 Claims, 3 Drawing Sheets

FOREIGN PATENT DOCUMENTS

| | | |
|---|---|---|
| FR | 2 555 630 | 5/1985 |
| GB | 156973 | 1/1921 |
| GB | 2365456 | 2/2002 |
| RU | 84345 | 9/1949 |
| WO | 95/09953 | 4/1995 |

* cited by examiner

SELF-SUPPORTING CONSTRUCTION ELEMENT MADE OF EXPANDED PLASTIC MATERIAL, IN PARTICULAR FOR MANUFACTURING BUILDING FLOORS AND FLOOR STRUCTURE INCORPORATING SUCH ELEMENT

FIELD OF THE INVENTION

In one general aspect thereof, the present invention relates to a self-supporting construction element made of expanded plastic material, in particular for the manufacture of floors of buildings in general.

More particularly, the present invention relates to a self-supporting construction element comprising:

a) an elongated body made of expanded plastic material, substantially parallelepipedic and provided with respectively lower and upper opposite faces;

b) at least one reinforcing section bar transversely extending in said body between said faces.

In the following description and in the appended claims, the expression: self-supporting construction element, is used to indicate a construction element exhibiting such mechanical characteristics as to withstand without structural yielding the stresses undergone during transport and installation.

PRIOR ART

As is known, in the field of the building industry in general, the use of construction elements made of expanded plastic material, preferably expanded polystyrene, in the form of slabs or section bars of suitable shape and size and having the function of heat and sound insulation, has long become widespread.

It is also known that in order to impart suitable self-supporting characteristics to such construction elements it is necessary to incorporate or introduce one or more suitably shaped reinforcing section bars in the mass of expanded plastic material.

Thus, for example, European Patent EP 0 459 924 discloses a self-supporting construction element made of expanded plastic material, in particular a floor element, comprising a central body, substantially parallelepipedic, inside which a reinforcing section bar constituted by an I-shaped thin sheet is integrated during the molding operations.

While the construction elements of this kind feature a light weight, a comparative ease of installation and a low cost, their diffusion in the field and their flexibility of use have been restrained heretofore by the poor fire resistance they exhibit in case of fire.

In case of fire, in fact, the expanded plastic material quickly shrinks and forms a shapeless mass of reduced volume, with the consequent detachment of the reinforcing section bar(s) inserted therein and, optionally, of the finishing and covering elements, such as one or more layers of plaster or plasterboard panels, associated to a lower side of the elongated body made of expanded plastic material or to the reinforcing section bar.

SUMMARY OF THE INVENTION

The technical problem underlying the present invention is therefore that of providing a self-supporting construction element made of expanded plastic material which allows to overcome the disadvantages mentioned above with reference to the prior art.

According to the invention, this problem is solved by a construction element of the type indicated hereinabove, which is characterized in that the elongated body made of expanded plastic material is provided with at least one recess open at an upper side for housing a concrete casting and in that said at least one reinforcing section bar extends at least in part in said at least one recess.

Advantageously, the construction element of the invention is capable of achieving at the same time both adequate self-supporting characteristics, imparted thereto by the reinforcing section bar extending in the mass of expanded plastic material, and adequate characteristics of fire resistance in case of fire, thanks to the presence of the aforementioned at least one recess open at an upper side which allows to anchor the reinforcing section bar, and optionally the covering elements fastened thereto, to the concrete layer, for example to the slab of a floor structure, formed above the construction element.

In a first preferred embodiment of the invention, the elongated body made of expanded plastic material of the construction element comprises a plurality of recesses reciprocally spaced and aligned with one another at the aforementioned at least one reinforcing section bar along a direction substantially parallel to the longitudinal axis of the body itself.

In this way, it is advantageously possible to have a sufficient number of anchoring points of the reinforcing section bar to the concrete casting achieving at the same time an optimum heat and sound insulation effect.

In an alternative preferred embodiment, the aforementioned at least one recess is longitudinally extending in the elongated body made of expanded plastic material along a direction substantially parallel to the longitudinal axis thereof at the aforementioned at least one reinforcing section bar.

In a second preferred embodiment of the invention, the aforementioned at least one recess is transversely extending in the elongated body made of expanded plastic material between opposite sides thereof.

Within the framework of this preferred embodiment, the construction element of the invention may further comprise at least one reinforcement metal structure of the casting housed in the aforementioned at least one transversal recess.

Thanks to this combination of features, it is advantageously possible to increase the load resistance characteristics of the floor structure that can be manufactured with the construction elements formed in this way, also decreasing the number of supporting beams.

Alternatively, it is possible to decrease the overall thickness of the floor structure that can be manufactured with a construction element formed in this way while maintaining the same load-bearing characteristics.

A construction element of this kind, furthermore, achieves advantageous features of flexibility of use which allow its exploitation in the most varied applications, for example in combination with the aforementioned plurality of recesses spaced and longitudinally aligned along the elongated body made of expanded plastic material or in combination with a single recess longitudinally extending in the elongated body itself.

If the reinforcing section bar is provided with openings, furthermore, the reinforcement metal structure of the casting housed in the aforementioned at least one transversal recess is capable of carrying out the additional useful function of holding the reinforcing section bar and the construction element associated thereto during the installation of the floor structure and the pouring operations of the concrete casting.

Preferably, the aforementioned at least one reinforcing section bar is provided with opposite free ends protruding from longitudinally opposite sides of the elongated body made of expanded plastic material.

In this way, it is advantageously possible to lay the construction element on the supporting structures of the building being erected, such as load-bearing beams or load-bearing walls.

In a particularly preferred embodiment of the invention, the aforementioned at least one reinforcing section bar is provided with at least one lower portion extending substantially parallel to the lower face of the elongated body made of expanded plastic material.

Advantageously, this lower portion constitutes a supporting means adapted to allow the anchoring of suitable covering elements of the lower face of the elongated body made of expanded plastic material to the reinforcing section bar and therefore to the concrete casting.

In this embodiment, the aforementioned covering elements may be advantageously fastened to the lower portion of the reinforcing section bar in any conventional manner known per se such as, for example, by means of screws of suitable length.

Preferably, the aforementioned at least one reinforcing section bar is made of metal and is preferably shaped as an L, a C, a Z, an upturned T or an I.

Advantageously, these shapes allow to have a reinforcing section bar having a suitable combination of low weight, reduced thickness, adequate characteristics of mechanical resistance and a shape adapted to provide a structural element (the aforementioned portion extending substantially parallel to the lower face of the elongated body) which a suitable covering element of the expanded plastic material can be fastened to.

According to a preferred embodiment of the invention, the reinforcing section bar is longitudinally extending in the elongated body of the construction element along substantially the entire length thereof.

Within the framework of the preferred embodiments of the reinforcing section bar mentioned hereinabove, the latter is provided with a central portion and with at least one fin extending from the lower end of the central portion of the reinforcing section bar.

In this preferred embodiment, the lower portion of the reinforcing section bar extending substantially parallel to the lower face of the elongated body made of expanded plastic material is therefore constituted by the aforementioned lower fin.

Portions of predetermined length of the reinforcing section bar can be obtained by means of conventional bending and shearing operations, known per se, starting from a sheet of metal having a height comprised between about 100 mm and about 300 mm and, still more preferably, comprised between about 120 mm and about 250 mm and a thickness comprised between about 0.4 mm and about 1.2 mm and, still more preferably, comprised between about 0.5 mm and about 0.8 mm.

Within the framework of the present description and in the following claims, except where otherwise indicated, all numbers expressing amounts, quantities, percentages, and so forth, are to be understood as being modified in all instances by the term "about". Also, all ranges include any combination of the maximum and minimum points disclosed and include any intermediate ranges therein, which may or may not be specifically enumerated herein.

Preferably, the central portion of the reinforcing section bar has, after bending, a height comprised between about 60 mm and about 285 mm, while the lower fin of the section bar has a length comprised between about 15 mm and about 40 mm and, still more preferably, comprised between about 30 mm and about 37 mm.

Preferably, the lower fin of the reinforcing section bar comprises a first rectilinear portion, substantially perpendicular to the central portion of the section bar and an end portion forming, with respect to the first portion of the fin, an angle ($\alpha$) comprised between about 80° and about 90° and, still more preferably, equal to about 90°.

Tests carried out by the Applicant have shown that such a configuration of the fin contributes to increase the characteristics of resistance to the bending loads acting along a transversal direction, such as those which are generated during the pouring operations of the concrete casting or during the laying operations of the construction element.

Within the framework of this preferred embodiment, the first rectilinear portion of said fin, substantially perpendicular to the central portion of the reinforcing section bar, has a length preferably comprised between about 12 and about 18 mm, whereas the remaining end portion thereof is bent so as to form with the first portion, an angle equal to about 90°, that is, bent so as to be substantially parallel to the central portion of the reinforcing section bar.

In a preferred embodiment, the lower portion of the aforementioned at least one reinforcing section bar is extending flush with the lower face of the elongated body made of expanded plastic material.

In this case, the structural element which allows the fastening of the covering element is easily detectable once the floor structure incorporating the construction elements of the invention is laid, to the advantage of the fastening operations of said covering element.

In an alternative preferred embodiment, the lower portion of the aforementioned at least one reinforcing section bar is entirely incorporated in mass of expanded plastic material and is arranged at a predetermined distance from the lower face of the elongated body made of expanded plastic material.

In this case, the construction element of the invention achieves enhanced characteristics of versatility since it can be used as it is, or provided with a finishing and covering element constituted by a plaster layer directly sprayed on the lower face made of expanded plastic material of the elongated body, or also provided with more complex covering elements fastened to the lower portion of the reinforcing section bar by means of fastening elements of suitable length, such as for example screws.

In a preferred embodiment, the elongated body made of expanded plastic material is provided with at least one suitably shaped longitudinal seat adapted to house, preferably with a substantial shape mating, the aforementioned at least one reinforcing section bar.

Preferably, this longitudinal seat is formed in the elongated body made of expanded plastic material during the manufacturing operations of the latter, which generally provide the molding of the elongated body with methods known per se. Alternatively, the longitudinal seat can be formed in the elongated body made of expanded plastic material after its manufacture by means of a suitable cutting device, for example of the hot wire type.

Within the framework of this preferred embodiment, the reinforcing section bar can therefore be manufactured separately and inserted by sliding or snap-fitted in the corresponding longitudinal seat formed in the elongated body made of expanded plastic material.

Preferably, the aforementioned at least one reinforcing section bar is provided at an upper side with a longitudinal projection which advantageously allows to increase the resistance characteristics to the combined bending and compressive stress of the reinforcing section bar.

If the aforementioned longitudinal seat for housing the reinforcing section bar is present, the longitudinal projection is also adapted to cooperate in abutment relationship with a respective longitudinal shoulder formed in the seat.

In this way, the longitudinal projection facilitates the snap-fitting engagement of the reinforcing section bar in its housing seat.

Advantageously, furthermore, said longitudinal projection is capable of effectively holding in place the reinforcing section bar during the transport and/or installation operations of the construction element, thanks to the cooperation in abutment relationship with the longitudinal shoulder formed in the housing seat of the reinforcing section bar.

Preferably, the aforementioned longitudinal projection is essentially constituted by a folded portion of said at least one reinforcing section bar. Advantageously, this folded portion can be constituted by an edge of the reinforcing section bar folded back one to three times.

In this way and thanks to the elasticity characteristics of the material which constitutes the reinforcing section bar (preferably made of metal), it is advantageously possible to achieve a sort of "spring effect" which further improves the effect of snap-fitting engagement of the reinforcing section bar in its housing seat.

Within the framework of this preferred embodiment, the aforementioned at least one reinforcing section bar can be further associated by gluing to the elongated body made of expanded plastic material.

In this case, it is preferable and advantageous to apply a suitable glue, for example a polyurethane glue, at selected points or in a layered manner, on at least one portion of the reinforcing section bar intended to come in contact with the elongated body made of expanded plastic material, for example on the central portion thereof.

In an alternative preferred embodiment, the aforementioned at least one reinforcing section bar is integrated in the expanded plastic material of the elongated body.

In this case, it is preferable and advantageous to carry out this integration at the molding stage of the elongated body itself, for example according to the operating steps described in European patent EP 0 732 733 in the name of the same Applicant.

In a preferred embodiment, the construction element of the invention comprises a pair of reinforcing section bars longitudinally extending in the elongated body made of expanded plastic material at opposite parts of a longitudinal center plane thereof.

Thanks to this arrangement of the reinforcing section bars, it is advantageously possible to achieve even reinforcement characteristics of the elongated body at opposite parts of the aforementioned longitudinal center plane. Preferably, the reinforcing section bars are symmetrically arranged in the elongated body with respect to said plane so as to achieve a balanced and symmetrical reinforcing action.

In this preferred embodiment, the reinforcing section bars of the aforementioned pair are preferably spaced apart from one another by a predetermined distance.

In this way, it is advantageously possible to suitably distribute the reinforcing section bars within the elongated body made of expanded plastic material, thereby achieving some advantageous technical effects: possibility of homogeneously distributing the reinforcing action exerted by the reinforcing section bars; possibility of homogeneously distributing the loads applied to the reinforcing section bars (essentially the weight of the covering elements fastened to their lower portion) and, finally, possibility of arranging in a known and reproducible manner the lower portion of the reinforcing section bars so as to know its position even when said lower portion is entirely incorporated in the mass of expanded plastic material and as such, is not visible from the outside.

Preferably, the distance between the center line of the lower portion of the reinforcing section bars—measured along a direction substantially perpendicular to the longitudinal axis of the elongated body made of expanded plastic material—is comprised between about 250 mm and about 350 mm and, still more preferably, it is equal to about 300 mm.

In a preferred embodiment, the reinforcing section bar(s) is (are) advantageously provided with a plurality of openings formed in the central portion thereof.

Such openings carry out a series of advantageous functions:

i) they lighten the reinforcing section bar;

ii) they allow an even more intimate integration of the reinforcing section bar in the mass of expanded plastic material if the reinforcing section bar is integrated in the elongated body made of expanded plastic material during the manufacturing operations thereof; and iii) they allow, as mentioned hereinabove, the introduction of a reinforcement metal structure through the reinforcing section bar if the elongated body made of expanded plastic material is provided with a transversal recess for housing the concrete casting.

If the reinforcing section bar is integrated in the elongated body made of expanded plastic material during the manufacturing operations thereof, the mass of expanded plastic material is in this way advantageously capable of interpenetrating with the reinforcing section bar at the molding stage, integrating and firmly holding in place the reinforcing section bar within the elongated body of the construction element.

This intimate integration of the reinforcing section bar in the mass of expanded plastic material, furthermore, prevents any deformation or bending along the transversal direction of the reinforcing section bar even though the latter is essentially constituted, as mentioned hereinbefore, by a fairly thin metal sheet.

Preferably, the aforementioned openings have a total area comprised between about 10% and about 40% of the total area of the reinforcing section bar, where the expression: total area of the reinforcing section bar, is used to indicate the area of the overall lateral surface of the section bar including that of its fin(s) (that is, the area of the total lateral surface before forming the fins and the openings).

Still more preferably, the openings formed in the central portion of the reinforcing section bar have a total area comprised between about 20% and about 30% of the total area of the reinforcing section bar.

According to the invention, the shape of the openings—obtainable in any way known per se, such as for example by punching—is not critical; in any case, it is preferably circular for obvious reasons of construction simplicity.

In this case, the openings have a diameter preferably comprised between about 15 mm and about 150 mm.

In a preferred embodiment of the invention, the openings are arranged in the central portion of the reinforcing section bar according to a row extending substantially astride the center plane of the central portion of the reinforcing section bar.

In an alternative preferred embodiment, the openings are arranged in the central portion of the reinforcing section bar according to three parallel rows: a first central row of circular openings, having a prevailing diameter, pitchwise arranged along the center plane of the central portion of the reinforcing section bar, and two lateral rows of circular openings, having a smaller diameter, pitchwise arranged at opposite parts of the aforementioned central row.

Preferably, the circular openings of the lateral rows have parallel axes and are arranged between two consecutive openings of the central row, as will be better apparent in the description which follows.

Advantageously, it is possible in this way to distribute as evenly as possible the so-called void areas throughout the central portion of the reinforcing section bar, in order to lighten its structure without detracting from its mechanical strength, and to evenly distribute the contact surface between the reinforcing section bar and the expanded plastic material.

Preferably, the pitch of the openings of the central row is equal to that of the lateral rows and is comprised between about 100 and about 300 mm.

Preferably, furthermore, the openings of the central row have a diameter comprised between about 50 mm and about 80 mm and, still more preferably, equal to about 70 mm, while the openings of the lateral rows have a diameter comprised between about 20 mm and about 40 mm and, still more preferably, equal to about 30 mm.

In a preferred embodiment, the construction element further comprises at least one covering element associated to the lower face of the elongated body made of expanded plastic material. Preferably, the covering element also constitutes a finishing element of the lower face of the elongated body made of expanded plastic material.

In this way, it is advantageously possible to impart the desired characteristics of surface finishing and of aesthetic appearance to the lower face of the construction element and of the floor structure which can be manufactured by arranging side by side a plurality of such construction elements.

In a preferred embodiment, the aforementioned at least one covering element comprises a lath for supporting at least one layer of a suitable covering material.

Preferably, the lath comprises a mesh structure, provided or not with protruding ribs, and is obtained by stretching a suitably notched metal sheet.

Preferably, the lath for supporting at least one covering layer is a stretched metal lath formed by a rhomb-shaped mesh having a length-to-height rhomb ratio of 2:1.

Preferably, the rhomb length varies between about 20 and about 60 mm, while the rhomb width varies between about 10 and about 30 mm.

In an alternative preferred embodiment, the aforementioned at least one covering element can comprise a sheet-like element of a suitable material, for example metal or plastic material, usable per se as a finishing element or as an element adapted to support a layer of a suitable covering material.

In the aforementioned preferred embodiments, the lath or the sheet-like element have a thickness comprised between about 0.4 mm and about 1.0 mm and, still more preferably, comprised between about 0.4 mm and about 0.8 mm.

Preferably, the lath or the sheet-like element comprise opposite lateral portions housed in respective longitudinal housing grooves formed in opposite sides of the elongated body made of expanded plastic material.

In this way, the lath or the sheet-like element can be firmly held by the elongated body made of expanded plastic material by simply crimping their lateral portions in the aforementioned grooves.

Advantageously, furthermore, these lateral portions allow to firmly anchor the lath or the sheet-like element to the concrete casting poured in the space defined between the sides of adjacent construction elements.

In order to increase as much as possible the fire resistance characteristics of the construction element, the material of the covering layer associated to the lath or to the sheet-like element is preferably selected between plaster, cement, or other material having fire-retardant and fire resistance properties, such as for example combinations of cement with reinforcing fibers of a suitable material.

In a preferred embodiment and in order to increase as much as possible the characteristics of fire resistance of the construction element, the lath or the sheet-like element are associated to the lower portion, for example to a lower fin, of the aforementioned at least one reinforcing section bar.

In this way, it is advantageously possible to increase the capacity of the construction element of holding the lath or the sheet-like element, since the latter are ultimately firmly associated to the concrete casting by means of the reinforcing section bar and, optionally, by means of the aforementioned lateral portions.

In an alternative preferred embodiment, the aforementioned at least one covering element of the lower face of the elongated body made of expanded plastic material comprises a rigid covering element.

Preferably, this rigid covering element is associated to the lower portion, for example to a fin, of the aforementioned at least one reinforcing section bar.

Also in this case, it is advantageously possible to increase the fire resistance characteristics of the construction element, since the rigid covering element is firmly associated to the concrete casting by means of the reinforcing section bar.

Preferably, the aforementioned rigid covering element is a panel of plasterboard, wood, rigid plastic material or other suitable material having ornamental and/or structural function.

Within the framework of the preferred embodiments wherein the surface covering element is firmly associated to the reinforcing section bar and therefore to the concrete casting, furthermore, the construction element of the invention advantageously allows to prevent any separation phenomena of the outer covering elements even in the presence of a possible early "aging" of the surface of the plastic material which may be triggered by heat sources, dusts, smokes, vapors or aggressive chemical agents coming from a source close to the construction elements themselves.

According to a further aspect thereof, the present invention also relates to a floor structure comprising a plurality of composite construction elements of the type described above, laying on or in any case supported by respective supporting structures of a building, such as for example load-bearing walls or load-bearing beams.

When the floor structure has a length of more than about 1.5-2 meters, furthermore, it is preferable to arrange suitable supporting elements suitably spaced from one another, the so-called "temporary supports", under the floor structure being manufactured with the construction elements.

In a preferred embodiment, the floor structure of the invention further comprises at least one covering element associated to the lower face of the elongated body made of expanded plastic material of the construction elements.

In this way it is advantageously possible to impart suitable finishing characteristics to the floor structure; if the outer covering element is firmly associated to the reinforcing section bar of the construction elements, furthermore, it is possible to further increase the fire resistance characteristics of the floor structure.

BRIEF DESCRIPTION OF THE DRAWINGS

Additional features and advantages of the invention will become more readily apparent from the description of some preferred embodiments of a construction element and of a floor structure according to the invention, made hereinafter by way of a non-limiting example with reference to the annexed drawings.

In the drawings:

With reference to FIG. 1, a self-supporting construction element according to a first embodiment of the present invention is generally indicated at 1.

Figure 1:
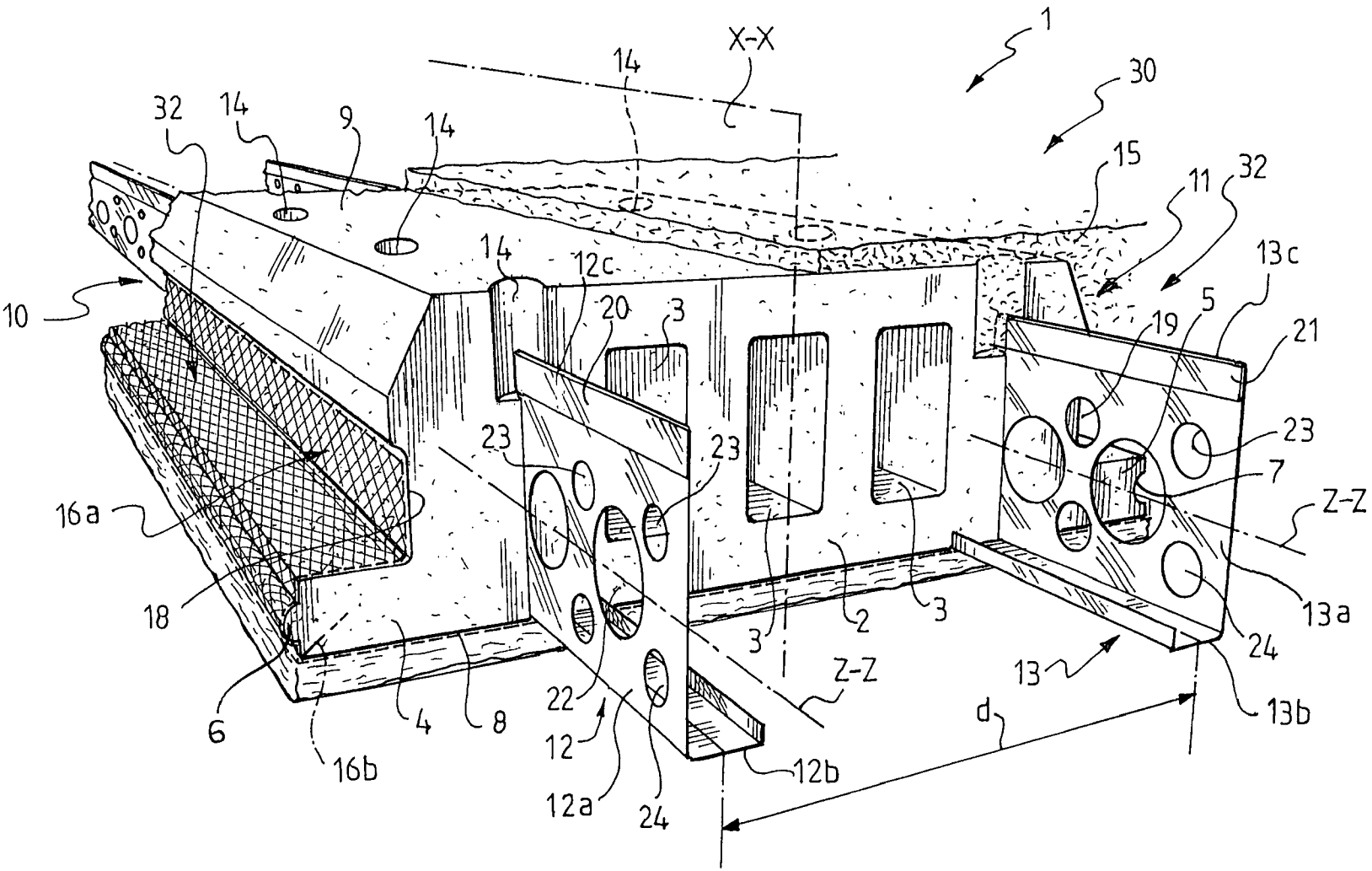
FIG. 1 shows a perspective view, in partial cross-section, of a first preferred embodiment of a construction element and of a portion of a floor structure according to the invention.

In the illustrated example, the construction element 1 is a so-called floor element intended for the manufacture of floors and it comprises a substantially parallelepipedic elongated body 2 made of expanded plastic material, for example of expanded polystyrene, wherein a plurality of parallel recesses 3 is longitudinally defined.

The construction element 1 is further provided with a pair of lugs 4, 5 laterally and longitudinally extending at opposite parts of the elongated body 2.

Advantageously, the lugs 4, 5 are laterally provided with a rib 6 and, respectively, with a groove 7, having a mating shape, longitudinally extending along the entire length of the construction element 1.

In this way, a plurality of construction elements 1 arranged side by side can be firmly connected to one another with a substantially joint-wise coupling so as to form a floor structure 30 a portion of which is shown in FIG. 1.

The elongated body 2 of the construction element 1 is provided with respectively lower and upper opposite faces 8, 9, and with two opposite sides 10, 11 from which the aforementioned lugs 4, 5 are extending.

The construction element 1 further comprises at least one longitudinal reinforcing section bar, preferably a pair of reinforcing section bars 12, 13, structurally identical, transversely extending in the elongated body 2 between the opposite faces 8, 9 thereof.

In this first embodiment of the construction element 1, the reinforcing section bars 12, 13 are integrated in the expanded plastic material of the elongated body 2 at the molding stage of the elongated body itself, for example according to the operating steps described in European patent EP 0 732 733.

Advantageously, the reinforcing section bars 12, 13 are arranged in a mirror fashion with respect to a longitudinal center plane X-X of the construction element 1.

The reinforcing section bars 12, 13 are longitudinally extending in the elongated body 2 of the construction element 1 preferably along substantially the entire length thereof between the aforementioned upper and lower faces 8, 9 of the elongated body 2.

According to the invention, the elongated body 2 made of expanded plastic material is provided at an upper side with at least one recess, preferably with a plurality of recesses 14 reciprocally spaced and aligned with one another along a direction substantially parallel to the longitudinal axis 14*a* of the elongated body 2 at the reinforcing section bars 12, 13.

The recesses 14 are open at an upper side for housing a concrete casting 15 which is also housed in spaces 32 defined between the sides 10, 11 of adjacent construction elements 1 when they are arranged side by side to form the floor structure 30.

In the preferred embodiment illustrated, the recesses 14 are extending in the elongated body 2 substantially perpendicularly to the upper face 9 thereof and are constituted by blind circular holes having a diameter preferably comprised between about 30 and about 80 mm and a depth preferably comprised between about 80 and about 250 mm.

Preferably, the recesses 14 are formed in the elongated body 2 made of expanded plastic material at an upper portion of the reinforcing section bars 12, 13 and are aligned along a direction substantially coinciding with that of the upper end edge 12*c*, 13*c* of such section bars.

Thanks to this arrangement of the recesses 14, the reinforcing section bars 12, 13 extend at least in part in the recesses 14 so as to be incorporated by the concrete casting 15 and be firmly held by the latter once its hardening is complete.

In this preferred embodiment, the reinforcing section bars 12, 13 extend in the recesses 14 at an upper end portion of respective central portions 12*a*, 13*a* thereof.

Preferably, the reinforcing section bars 12, 13 are made of a material having suitable structural characteristics, for example cold-rolled and preferably galvanized steel, shaped in a suitable manner and having a thickness comprised between, for example, about 0.4 mm and about 0.8 mm.

In the preferred embodiment illustrated, the reinforcing section bars 12, 13 are substantially L-shaped and can be obtained by conventional bending and shearing operations, known per se, starting from a metal sheet having a suitable width and thickness.

Once these operations have been carried out, the reinforcing section bars 12, 13 are provided with the aforementioned central portion 12*a*, 13*a* and with a lower fin 12*b*, 13*b* extending substantially perpendicular to the central portion of the section bar.

Advantageously, the lower fins 12*b*, 13*b* of the reinforcing section bars 12, 13 form as many lower portions of the section bars extending substantially parallel to the lower face 8 of the elongated body 2 made of expanded plastic material.

The lower fins 12*b*, 13*b*, therefore, constitute effective supporting means adapted to allow the anchoring of a suitable covering element of the lower face 8 of the elongated body 2 made of expanded plastic material to the reinforcing section bars 12, 13 and thus to the concrete casting 15.

In this embodiment, the aforementioned covering element can be constituted by a lath 16 for supporting at least one layer 17 of a suitable material, for example plaster.

The lath 16 may be advantageously fastened to the lower portion of the reinforcing section bars 12, 13 in a conventional manner known per se, for example by means of electrical welding to the lower fins 12*b*, 13*b* thereof.

As it can be seen in FIG. 1, the fins 12*b*, 13*b* are extending substantially flush with and are substantially parallel to the lower face 8 of the elongated body 2 of the construction element 1.

Advantageously, the lath 16 is suitably folded at its opposite lateral ends, so as to cover the lateral lugs 4, 5 and have an end portion 16*a* extending along a substantially vertical direction and partially flush with the opposite sides 10, 11 of the elongated body 2.

Alternatively, the lath 16 can be provided with a first inclined portion 16*b* (illustrated with a dot and dash line in FIG. 1) entirely incorporated in the lateral lugs 4, 5, and provided with the aforementioned end portion 16*a*.

Advantageously, the complete incorporation of the lath portion 16*b* in the mass of expanded plastic material prevents the formation of thermal bridges between the lower and upper faces of the lugs 4 and 5 in the floor structure 30 manufactured by arranging side by side a plurality of construction elements 1.

The opposite end portions 16*a* of the lath 16 are housed in grooves 18, 19 longitudinally formed in the sides 10, 11 of the elongated body 2 over the aforementioned lugs 4, 5, which grooves constitute as many housing seats for the end portions 16*a*.

Advantageously, the latter provide an additional anchoring zone of the lath 16 to the concrete casting 15 at the space 32 defined between the sides of adjacent construction elements 1.

Preferably, the lath 16 is a stretched metal lath obtained from a cold-rolled and galvanized metal sheet of the so-called "zenzimir" type, adapted to receive concrete, lime or plaster and being corrosion-resistant.

In a preferred embodiment, the lath 16 has a thickness equal to about 0.5 mm and is constituted by a rhomb-shaped mesh having a length-to-height rhomb ratio of 2:1.

Preferably, furthermore, the rhomb length is equal to 30 mm, while the rhomb height is equal to about 15 mm.

Preferably, the lower fin 12*b*, 13*b* of the reinforcing section bars 12, 13 comprises a first rectilinear portion, substantially perpendicular to the central portion 12*a*, 13*a* of the section bar and an end portion forming, with respect to the first fin portion, an angle substantially equal to about 90°.

In the preferred embodiment illustrated in FIG. 1, the reinforcing section bars 12, 13 are arranged in the elongated body 2 at a predetermined distance from one another; preferably, the distance d between the center line of the lower fins 12*b*, 13*b*—measured along a direction substantially perpendicular to the longitudinal axis of the elongated body 2—is equal to about 300 mm.

In the preferred embodiment illustrated, the reinforcing section bars 12, 13 are provided at an upper side with respective longitudinal projections 20, 21 which advantageously allow to increase the resistance characteristics to the combined bending and compressive stress of the section bars themselves.

Preferably, the longitudinal projections 20, 21 are essentially constituted by an upper edge of the reinforcing section bars 12, 13 folded back two times.

In the preferred embodiment illustrated, the reinforcing section bars 12, 13 are provided with opposite free ends protruding from longitudinally opposite sides of the elongated body 2 made of expanded plastic material.

In this way, it is advantageously possible to lay the construction element 1 on the supporting structures, such as load-bearing beams or load-bearing walls, of the building being erected.

Preferably, furthermore, the reinforcing section bars 12, 13 are advantageously provided with a plurality of openings, preferably circular holes obtained by punching, formed in the central portion 12*a*, 13*a* thereof.

The aforementioned holes are arranged in the central portion 12*a*, 13*a* of the reinforcing section bars 12 and 13 according to three parallel rows: a first central row of circular holes 22, having a prevailing diameter, pitchwise arranged along a center plane Z-Z of the central portion 12*a*, 13*a* of the section bars 12, 13, and two lateral rows of circular holes 23, 24 having a smaller diameter, arranged at opposite parts of the aforementioned central row.

Preferably, the circular holes 23, 24 of the lateral rows have axes parallel to one another and are arranged between two consecutive holes 22 of the central row, as illustrated in FIG. 1.

Preferably, the holes 22 have a diameter equal to about 60 mm, while the holes 23 and 24 have a diameter equal to about 30 mm, while the pitch of the rows of holes 22-24 is equal to about 100 mm.

The aforementioned holes 22-24 thus define a perforated area or void area equal to about 30% of the total area of the reinforcing section bars 12 and 13, where the expression: total area of the reinforcing section bars, is used to indicate the area of the overall lateral surface of the section bars (central portion and fins).

The openings 22-24 carry out the dual advantageous function of lightening the reinforcing section bars 12, 13 and of allowing an intimate integration thereof in the mass of expanded plastic material.

Thanks to the presence of the openings 22-24, in fact, the mass of expanded plastic material is capable of interpenetrating with the reinforcing section bars 12, 13 at the molding stage, integrating and firmly holding in place the reinforcing section bars within the elongated body 2 of the construction element 1.

This intimate integration of the reinforcing section bars 12, 13 in the mass of expanded plastic material, furthermore, prevents any deformation or bending along the transversal direction of the reinforcing section bars 12, 13 even though they are essentially constituted by a fairly thin metal sheet.

The floor structure 30 comprising the construction elements 1 of the type illustrated above can be obtained by means of operations known per se which comprise laying a plurality of construction elements 1 side by side on respective supporting structures of a building, such as for example load-bearing walls or load-bearing beams, optionally arranging a reinforcement structure in the spaces 32 defined between the construction elements 1 and then, casting concrete on top of and between the construction elements 1 thus assembled.

When the floor structure has a length of more than about 1.5-2 meters, it is preferable to arrange under the floor structure 30 being manufactured suitable supporting elements suitably spaced from one another, the so-called "temporary supports", so as to prevent an undesired bending of the construction elements 1 when casting the concrete.

Advantageously, the construction element 1 described above is capable of achieving at the same time both adequate self-supporting characteristics, imparted thereto by the reinforcing section bars 12, 13 integrated in the mass of expanded plastic material, and adequate characteristics of fire resistance in case of fire, thanks to the presence of the recesses 14 which allow to anchor the reinforcing section bars and the lath 16 firmly held by the same to the concrete casting 15 formed above the construction element 1 and in the spaces 32 defined between adjacent construction elements.

In this case, the lath 16 is further anchored to the concrete casting 15 formed in the space 32 at the opposite end portions 16*a* thereof, housed in the grooves 18 and 19 laterally formed in the elongated body 2.

Furthermore, the lath 16 is in turn advantageously capable of supporting the plaster layer 17 even in case of total or partial shrinkage of the mass of expanded plastic material caused by heat.

Figure 2:
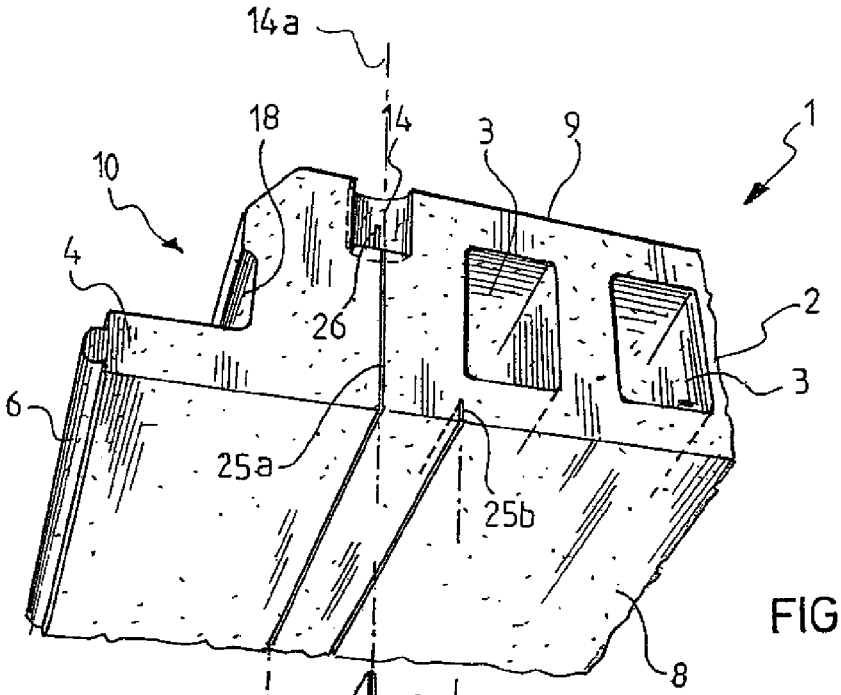
FIG. 2 shows an exploded perspective view, in enlarged scale, of some details of a second preferred embodiment of a construction element according to the invention.
Figure 3:
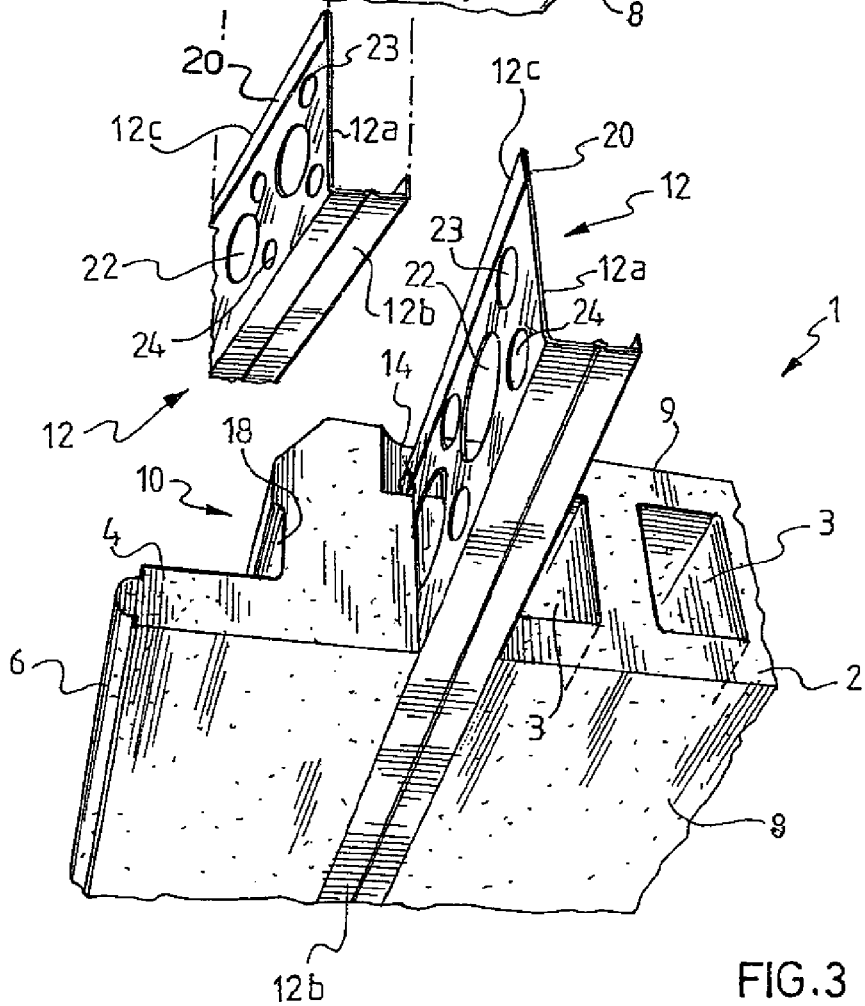
FIG. 3 shows a perspective view, in enlarged scale, of some details of the construction element of FIG. 2.
Figure 4:
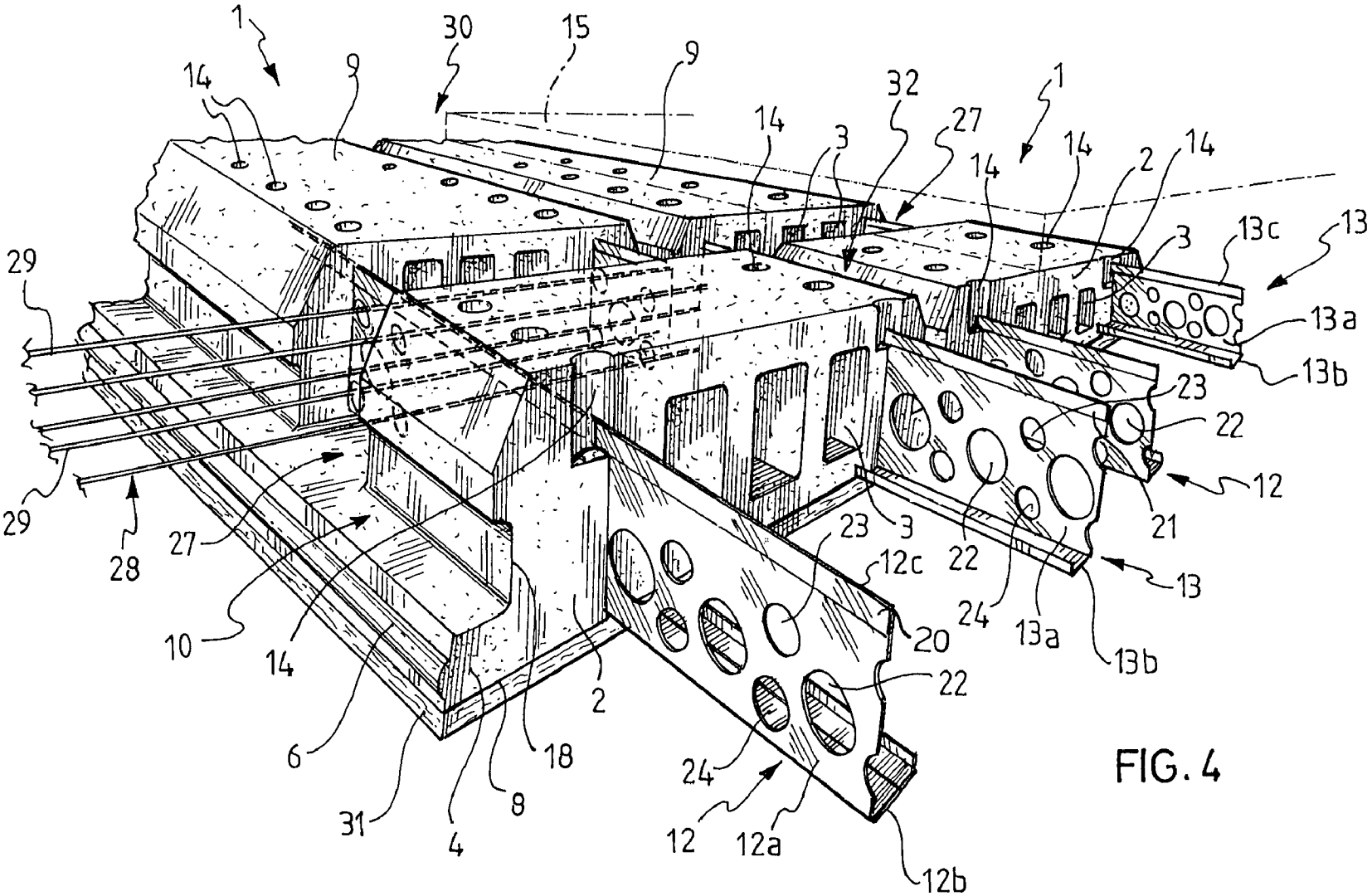
FIG. 4 shows a perspective view, in partial cross-section, of a third embodiment of a construction element according to the invention and of a portion of a floor structure incorporating such element.

FIGS. 2-4 schematically illustrate further alternative embodiments of the construction element 1 according to the present invention.

In the following description and in such figures, the components of the construction element 1 structurally or functionally equivalent to those illustrated with reference to the previous embodiment shall be indicated with the same reference numerals and will not be further described.

According to the embodiment of the invention illustrated in FIGS. 2 and 3, wherein only a portion of the construction element 1 is shown for the sole purpose of simplifying the present description, the elongated body 2 made of expanded plastic material is provided with at least one suitably shaped longitudinal seat adapted to house, preferably with a substantial mating coupling, each reinforcing section bar 12, 13.

In the preferred embodiment illustrated in these figures, the elongated body 2 made of expanded plastic material is provided with a pair of longitudinal seats 25*a*, 25*b* adapted to house the central portion 12*a*, 13*a* and the end portions of the lower fins 12*b*, 13*b* of the reinforcing section bars 12, 13.

Preferably, the longitudinal seats 25*a*, 25*b* are formed in the elongated body 2 made of expanded plastic material at the molding stage of the latter. Alternatively, the longitudinal seats 25*a*, 25*b* can be formed in the elongated body 2 after its manufacture by a means of suitable cutting device, for example of the hot wire type.

Within the framework of this preferred embodiment, therefore, the reinforcing section bars 12, 13 can be separately manufactured and inserted by sliding or snap-fitted in the corresponding longitudinal seats 25*a*, 25*b*.

In this preferred embodiment, the longitudinal projections 20, 21 are also advantageously capable of cooperating in abutment relationship with a respective longitudinal shoulder 26 formed in the seat 25*a*.

In this way, the longitudinal projections 20, 21 facilitate the snap-wise engagement of the reinforcing section bars 12, 13 in their housing seats and are capable of effectively holding in place the reinforcing section bars during transport and/or installation of the construction element 1.

Furthermore, the folded-edge configuration of the longitudinal projections 20, 21 advantageously allows to achieve a sort of "spring effect" which further improves the effect of snap-fitting engagement of the central portion 12*a*, 13*a* of the reinforcing section bars 12, 13 in its housing seat 25*a*.

Within the framework of the preferred embodiment illustrated in FIGS. 2 and 3, the reinforcing section bars 12, 13 can be further associated by gluing to the elongated body 2 made of expanded plastic material.

In this case, it is preferable and advantageous to apply a suitable glue, for example a polyurethane glue, at selected points or in a layered manner on at least one portion, for example on the outer face of the central portion 12*a*, 13*a* of the reinforcing section bars 12, 13, intended to come in contact with the elongated body 2 made of expanded plastic material.

This alternative embodiment of the construction element 1 of the invention achieves both the advantageous technical effects of the previous embodiment and the additional advantages achieved thanks to the possibility of introducing the reinforcing section bars 12, 13 in the elongated body 2 after the manufacture thereof, such as for example the possibility of using less complex and less expensive equipment for molding the elongated body 2 or the possibility of assembling the construction element 1 at any desired time.

According to the embodiment of the invention illustrated in FIG. 4, the construction element 1 is provided with at least one recess, preferably with a plurality of recesses 27 transversely extending in the elongated body 2 made of expanded plastic material between the sides 10, 11 thereof.

FIG. 4 further illustrates in more detail the floor structure 30 comprising a plurality of construction elements 1 arranged side by side and connected with each other in a way known per se thanks to the joint-wise coupling of the ribs 6 of each construction element in the grooves 7 of an adjacent construction element.

In this preferred embodiment, the construction element 1 further comprises at least one reinforcement metal structure, preferably a plurality of reinforcement metal structures 28 of the concrete casting 15, housed in the transversal recesses 27.

For the purposes of the invention, the reinforcement metal structures 28 can have any configuration suitable for the purpose. Thus, for example, the reinforcement metal structures 28 can comprise a plurality of rods 29 suitably arranged in the recesses 27, or they can be substantially constituted by trestles comprising, in a way know per se, a pair of longitudinal lower rods connected to at least one longitudinal upper rod by means of a plurality of lateral stiffening elements, such as for example metal rods.

Advantageously, the reinforcement metal structures 28 housed in the transversal recesses 27 are extending through the openings 22-24 formed in the central portion 12*a*, 13*a* of the reinforcing section bars 12, 13 and are capable of carrying out the useful function of holding each construction element 1 of the floor structure 30 during the laying operations and during the operations of pouring the concrete casting.

In this embodiment, each construction element 1 of the floor structure 30 is provided with a rigid covering element 31 for surface finishing purposes, for example a plasterboard panel.

Advantageously, the panels 31 are fastened to the lower fins 12*b*, 13*b* of the reinforcing section bars 12, 13 in a conventional manner known per se, for example by means of screws of suitable length (not shown).

This alternative embodiment of the construction element 1 of the invention achieves both the advantageous technical effects described hereinbefore with reference to the previous embodiments illustrated in FIGS. 1-3, and the further advantages achieved thanks to the presence of the recesses 27 and of the reinforcement metal structures 28:

- possibility of increasing the load-resistance characteristics of the floor structure 30 which can be manufactured with the construction elements 1 realized in this way, also decreasing the number of supporting beams;
- possibility of increasing, with the same load-bearing characteristics, the overall thickness of the floor structure 30 which can be manufactured with the construction elements 1 realized in this way;
- possibility of increasing the characteristics of flexibility of use of the construction elements 1 which allow their use in the most varied applications, for example in combination with the aforementioned plurality of recesses 14 spaced and longitudinally aligned along the elongated body 2 made of expanded plastic material.

Depending upon the type of rigid covering element chosen, the construction elements 1 of the invention can also achieve advantageous load-bearing characteristics, that is, be capable of autonomously withstanding any static loads applied thereon.

Clearly, a man skilled in the art may introduce modifications and variants to the invention described hereinbefore in order to meet specific and contingent application requirements, variants and modifications which anyway fall within the scope of protection as defined in the attached claims.

What is claimed is:

1. Self-supporting construction element comprising:

an elongated body made of expanded plastic material, substantially parallelepipedic and provided with respectively lower and upper opposite faces;

at least one reinforcing section bar of the body made of expanded plastic material transversely extending in said body between said faces;

wherein the elongated body made of expanded plastic material is provided with at least one longitudinal seat adapted to house said at least one reinforcing section bar; and where said at least one reinforcing section bar is provided at an upper side with a longitudinal projection which cooperates in abutment relationship with a respective longitudinal shoulder formed in said at least one longitudinal seat; and wherein the elongated body made of expanded plastic material is provided with a plurality of recesses formed within the body of expanded plastic material and open at an upper side for housing a concrete casting; and wherein said recesses are reciprocally spaced and aligned with one another at said at least one reinforcing section bar along a direction substantially parallel to the longitudinal axis of said body, and said upper side of said at least one reinforcing section bar extends in said recesses and in said at least one longitudinal seat.

2. Construction element according to claim 1, wherein said at least one of said recesses is longitudinally extending in the elongated body made of expanded plastic material along a direction substantially parallel to the longitudinal axis thereof at said at least one reinforcing section bar.

3. Construction element according to claim 1, wherein said at least one of said recesses is transversely extending in the elongated body made of expanded plastic material between opposite sides thereof.

4. Construction element according to claim 3, further comprising at least one reinforcement metal structure of the casting housed in said at least one transversal recess.

5. Construction element according to claim 1, wherein said at least one reinforcing section bar is provided with opposite free ends protruding from longitudinally opposite sides of the elongated body made of expanded plastic material.

6. Construction element according to claim 1, wherein said at least one reinforcing section bar is provided with at least one lower portion extending substantially parallel to the lower face of the elongated body made of expanded plastic material.

7. Construction element according to claim 1, wherein said at least one reinforcing section bar is shaped as an L, a C, a Z, an upturned T or an I.

8. Construction element according to claim 6, wherein the lower portion of said at least one reinforcing section bar is extending flush with the lower face of the elongated body made of expanded plastic material.

9. Construction element according to claim 6, wherein the lower portion of said at least one reinforcing section bar is entirely incorporated in the mass of expanded plastic material and is arranged at a predetermined distance from the lower face of the elongated body made of expanded plastic material.

10. Construction element according to claim 1, wherein said longitudinal projection is essentially constituted by a folded portion of said at least one reinforcing section bar.

11. Construction element according to claim 1, wherein said at least one reinforcing section bar housed in said at least one longitudinal seat is associated by gluing to the elongated body made of expanded plastic material.

12. Construction element according to claim 1, comprising a pair of reinforcing section bars longitudinally extending in the elongated body at opposite parts of a longitudinal center plane of said body.

13. Construction element according to claim 1, wherein said at least one reinforcing section bar is provided with a plurality of openings formed in a central portion thereof.

14. Construction element according to claim 13, wherein said reinforcement metal structure of the concrete casting is housed in one of the openings of said at least one reinforcing section bar.

15. Construction element according to claim 1, further comprising at least one covering element associated to the lower face of the elongated body made of expanded plastic material.

16. Construction element according to claim 15, wherein said at least one covering element comprises a lath for supporting at least one layer of a suitable covering material.

17. Construction element according to claim 15, wherein said at least one covering element comprises a sheet-like finishing element or a sheet-like element for supporting a layer of a suitable covering material.

18. Construction element according to claim 16, wherein said lath or said sheet-like element comprise opposite lateral portions housed in respective longitudinal housing grooves formed in opposite sides of the elongated body made of expanded plastic material.

19. Construction element according to claim 16, wherein said lath or said sheet-like element are associated to said lower portion of said at least one reinforcing section bar.

20. Construction element according to claim 16, wherein said covering material is plaster or cement optionally incorporating reinforcing fibers of a suitable material.

21. Construction element according to claim 15, wherein said at least one covering element comprises a rigid covering element.

22. Construction element according to claim 21, wherein said rigid covering element is associated to said lower portion of said at least one reinforcing section bar.

23. Construction element according to claim 21, wherein said rigid covering element is a panel of plasterboard, wood, rigid plastic material or other suitable material.

24. Floor structure comprising a plurality of construction elements according to claim 1.

25. Floor structure according to claim 24, comprising at least one covering element associated to the lower face of the elongated body made of expanded plastic material of said construction elements.

* * * * *